US011148270B2

(12) United States Patent
Wang

(10) Patent No.: US 11,148,270 B2
(45) Date of Patent: Oct. 19, 2021

(54) STAPLER

(71) Applicant: APEX MFG. CO., LTD., Taichung (TW)

(72) Inventor: Jing-Li Wang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 160 days.

(21) Appl. No.: 16/717,457

(22) Filed: Dec. 17, 2019

(65) Prior Publication Data

US 2021/0178564 A1 Jun. 17, 2021

(51) Int. Cl.
*B25C 5/06* (2006.01)
*B25C 5/15* (2006.01)

(52) U.S. Cl.
CPC . *B25C 5/06* (2013.01); *B25C 5/15* (2013.01)

(58) Field of Classification Search
CPC ..... B25C 5/06; B25C 5/15
See application file for complete search history.

(56) References Cited

U.S. PATENT DOCUMENTS 2,267,185 A * 12/1941 Bauwens ..... A42C 1/06 227/77
3,524,575 A * 8/1970 Hurkmans ..... B25C 5/15 227/7
5,516,025 A * 5/1996 Eriksson ..... B25C 5/0207 227/155
5,678,745 A * 10/1997 Yoshie ..... B25C 5/0207 227/155
6,036,074 A * 3/2000 Manabe ..... B27F 7/19 227/131
6,056,183 A * 5/2000 Tanabe ..... B25C 5/0264 227/155
6,371,352 B1 * 4/2002 Mochizuki ..... B27F 7/38 227/120
6,637,635 B2 * 10/2003 Borjesson ..... B27F 7/19 227/154
6,820,790 B2 * 11/2004 Ura ..... B27F 7/19 227/131

(Continued)

FOREIGN PATENT DOCUMENTS

TW M496540 3/2015

*Primary Examiner* — Thanh K Truong
*Assistant Examiner* — Katie L Gerth
(74) *Attorney, Agent, or Firm* — Muncy, Geissler, Olds & Lowe, P.C.

(57) ABSTRACT

A stapler is provided, including: a main body, a striking mechanism and a staple straightening mechanism. The main body includes an inner space and a staple outlet. The striking mechanism is disposed in the inner space and includes a striking member configured to strike a staple and a driving member by which the striking member is driven to move relative to the staple outlet. The staple straightening mechanism is disposed on the main body and includes an aperture corresponding to the staple outlet, at least one abutting member being movable within the aperture and a force accumulating assembly which is drivable by the driving member. The force accumulating assembly includes a blocking portion and a force accumulating member which is releasably blockable with the blocking portion, and the force accumulating member is movable toward the aperture to strike the at least one abutting member.

10 Claims, 10 Drawing Sheets

(56) References Cited

U.S. PATENT DOCUMENTS

| | | | | |
|---|---|---|---|---|
| 6,981,627 | B2 * | 1/2006 | Tsai | B25C 5/0228 227/154 |
| 7,124,926 | B1 * | 10/2006 | Tsai | B25C 5/0207 227/155 |
| 7,159,749 | B2 * | 1/2007 | Tsai | B25C 5/0207 227/155 |
| 7,938,306 | B2 * | 5/2011 | Sugihara | B27F 7/19 227/155 |
| 8,348,121 | B2 * | 1/2013 | Kishi | B27F 7/19 227/155 |
| 2004/0262363 | A1 * | 12/2004 | Elonsson | B25C 5/0271 227/76 |
| 2006/0273134 | A1 * | 12/2006 | Smith | B25C 5/0207 227/131 |
| 2007/0023474 | A1 * | 2/2007 | Smith | B25C 5/0207 227/155 |
| 2007/0210135 | A1 * | 9/2007 | Ivarsson | B25C 5/0207 227/134 |
| 2008/0116243 | A1 * | 5/2008 | Huang | B25C 5/161 227/132 |
| 2011/0062210 | A1 * | 3/2011 | Leung | B25C 5/0242 227/120 |
| 2013/0001269 | A1 * | 1/2013 | Aoki | B25C 5/1617 227/155 |
| 2014/0203060 | A1 * | 7/2014 | Marks | B27F 7/19 227/155 |
| 2017/0182645 | A1 * | 6/2017 | Marks | B25C 5/0228 |
| 2021/0178563 | A1 * | 6/2021 | Wang | B25C 5/0228 |

* cited by examiner

STAPLER

BACKGROUND OF THE INVENTION

Field of the Invention

The present invention relates to a stapler.

Description of the Prior Art

A conventional stapler has an anvil corresponding to a staple outlet, and the anvil has two recessions configured to press two legs of a staple so as to bend the two legs for bookbinding. However, the two legs are bent toward each other along the two recessions, and the two legs cannot be completely flattened on a surface of an object to be bound so that the object to be bound has a large thickness due to the staple, poor appearance and is inconvenient for document organization. Therefore, a stapler with a leg-flatting device is provided.

A conventional stapler with a leg-flatting device such as one disclosed in TWM496540 includes a main body, a sliding member being movably disposed on the main body and a moving member being liftably and swingably disposed on the sliding member. The moving member has an aperture corresponding to the staple outlet, and the aperture has an abutting member disposed therewithin and configured to press the staple. An elastic member is disposed between the abutting member and the main body so that the abutting member has a tendency to move in a direction toward the staple outlet. When the stapler is not in use, the moving member is blocked with the sliding member and cannot be swung downwardly; when a lever of the stapler is pressed to strike the staple and the staple penetrates through the object to be bound, the sliding member is moved backwardly and the moving member is disengaged from the sliding member and swung downwardly, so that the abutting member presses the two legs being bent so as to flatten the staple. However, the two legs cannot be effectively flattened if operating force is insufficient.

The present invention is, therefore, arisen to obviate or at least mitigate the above-mentioned disadvantages.

SUMMARY OF THE INVENTION

The main object of the present invention is to provide a stapler which can effectively flatten legs of a staple and provides good leg-flatting effect.

To achieve the above and other objects, the present invention provides a stapler, including a main body, a striking mechanism and a staple straightening mechanism. The main body includes an inner space and a staple outlet. The striking mechanism is disposed in the inner space and includes a striking member configured to strike a staple and a driving member by which the striking member is driven to move relative to the staple outlet. The staple straightening mechanism is disposed on the main body and includes an aperture corresponding to the staple outlet, at least one abutting member being movable within the aperture and a force accumulating assembly which is drivable by the driving member. The force accumulating assembly includes a blocking portion and a force accumulating member which is releasebly blockable with the blocking portion, and the force accumulating member is movable toward the aperture to strike the at least one abutting member. When the driving member drives the striking member to move toward the staple outlet, the driving member drives the force accumulating member to deform and accumulate force; when the force accumulating member is deformed to disengage from the blocking portion, the force accumulating member carries out the instantaneously pulsed strike on the at least one abutting member to move in a direction toward the staple outlet, and the at least one abutting member and the striking member press and straighten the staple.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Please refer to FIGS. 1 to 11 for a preferable embodiment of the present invention. A stapler 1 of the present invention includes a main body 10, a striking mechanism 20 and a staple straightening mechanism 30.

Figure 1:
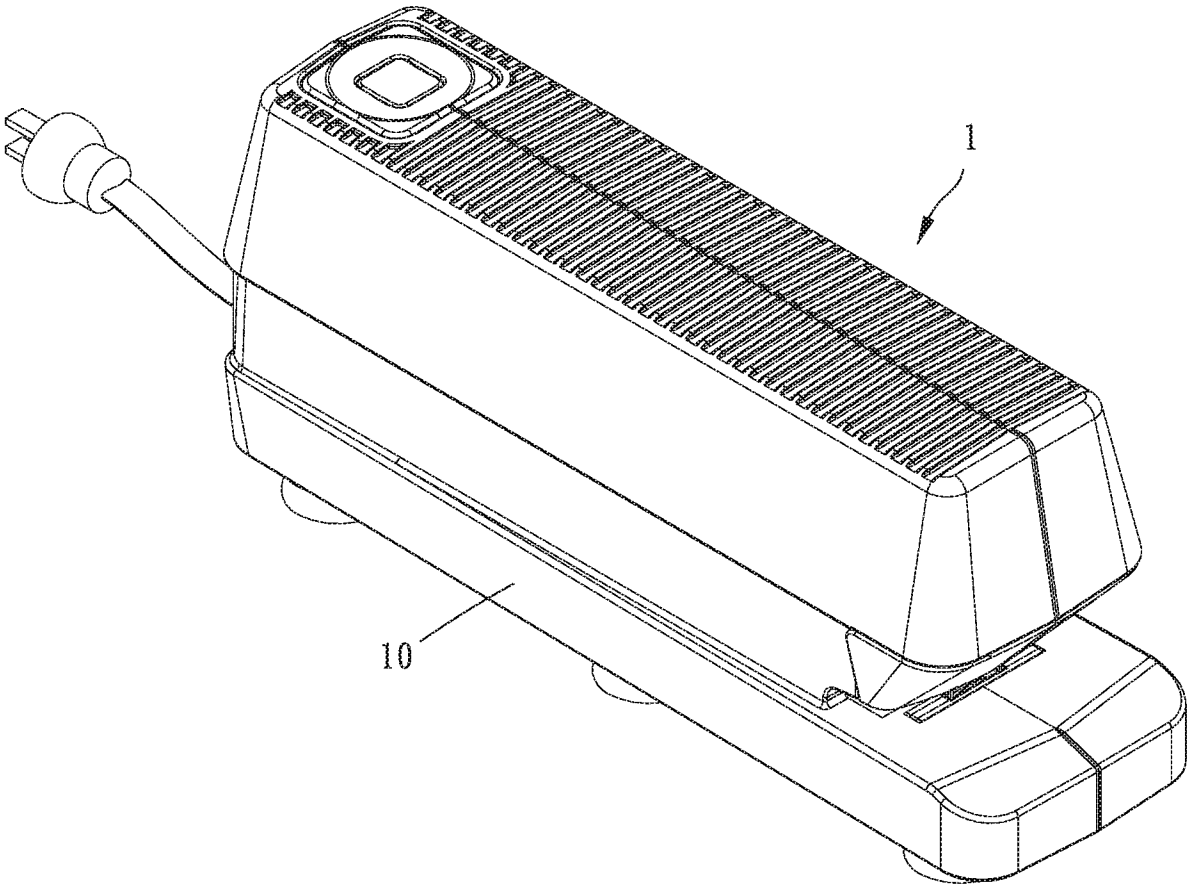
FIG. 1 is a stereogram of a preferable embodiment of the present invention.
Figure 2:
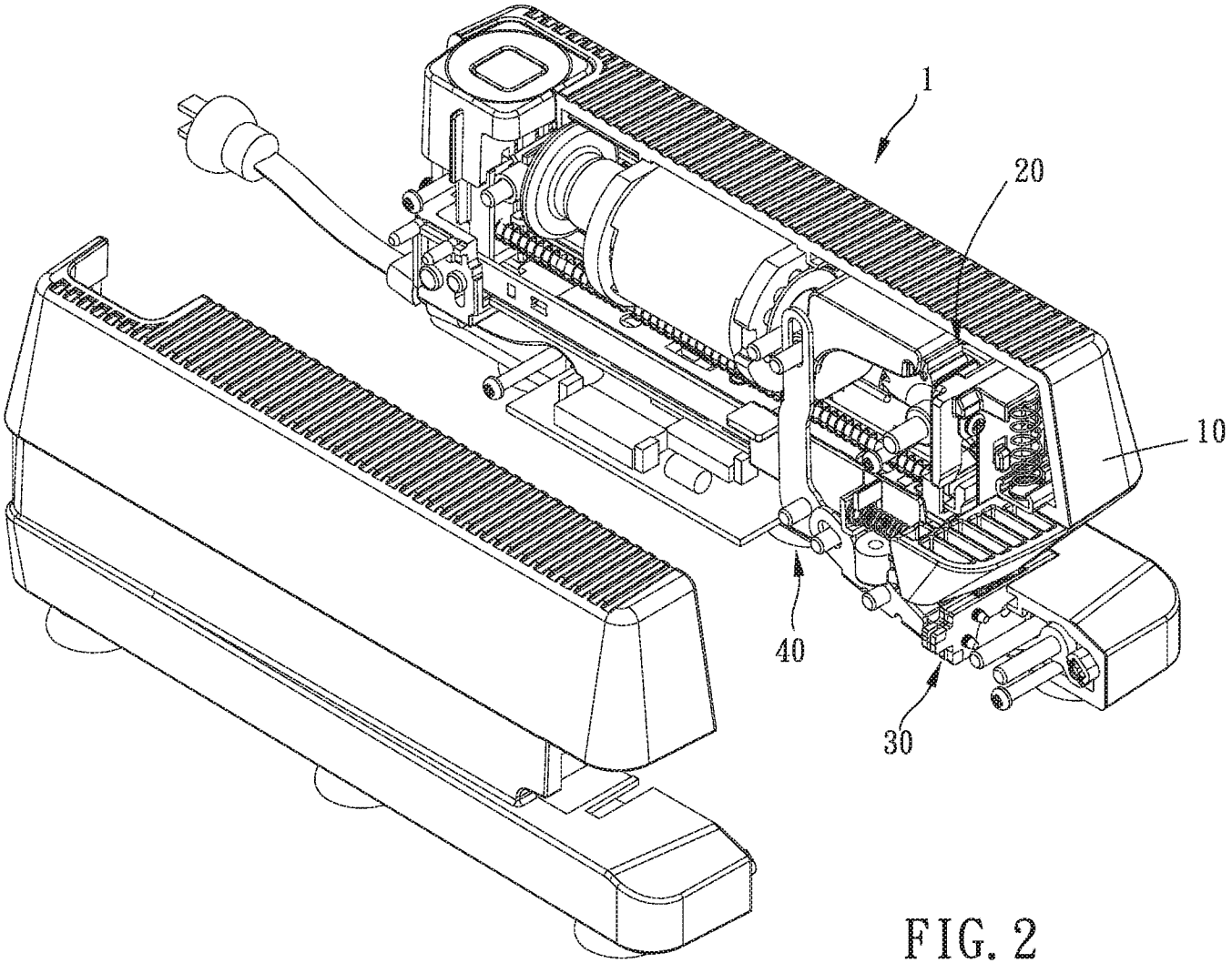
FIGS. 2 and 3 are partial breakdown drawings of a preferable embodiment of the present invention.
Figure 3:
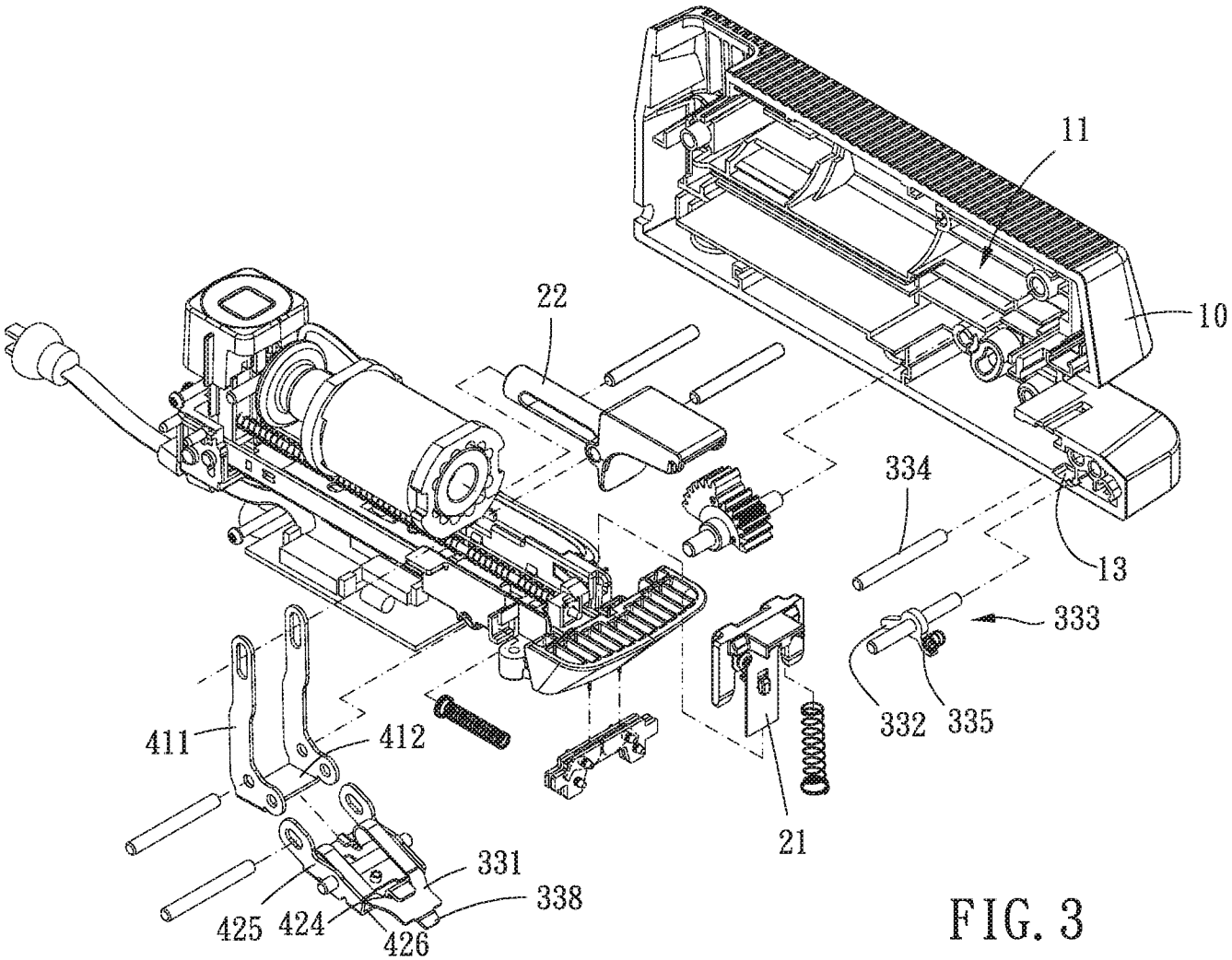
Figure 4:
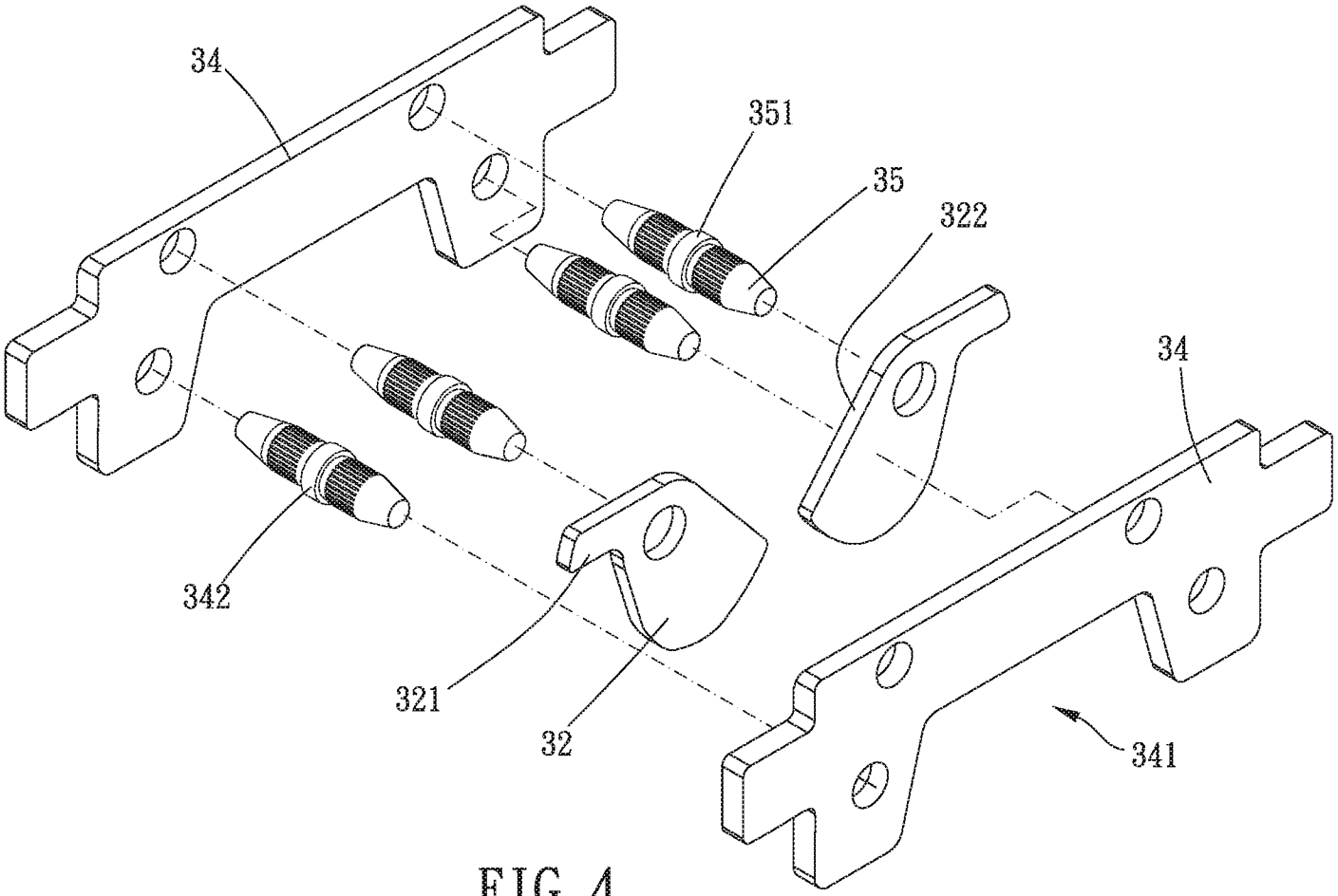
FIG. 4 is a partial breakdown drawing showing a staple straightening mechanism of a preferable embodiment of the present invention.
Figure 6:
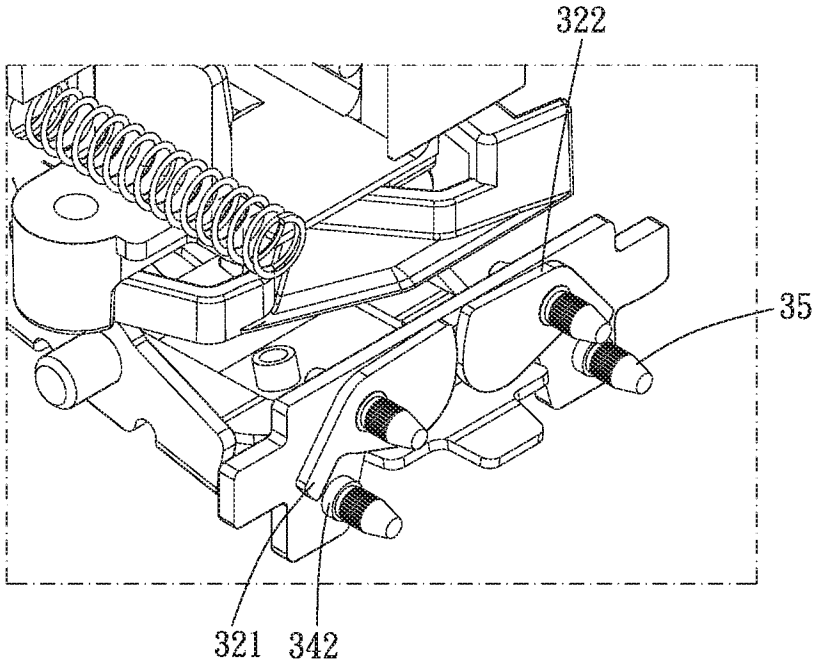
FIGS. 5 to 7 are schematic diagrams showing operation of the staple straightening mechanism of a preferable embodiment of the present invention.
Figure 5:
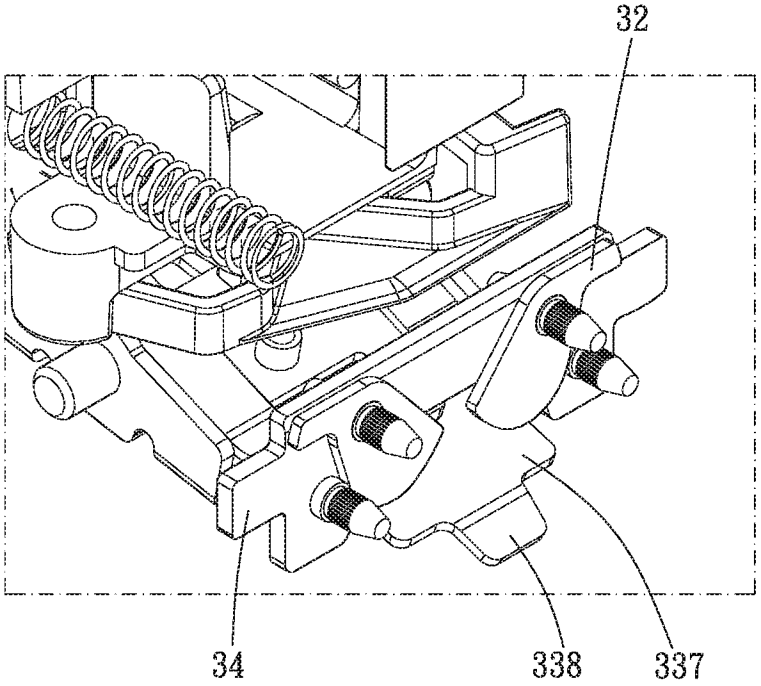
Figure 7:
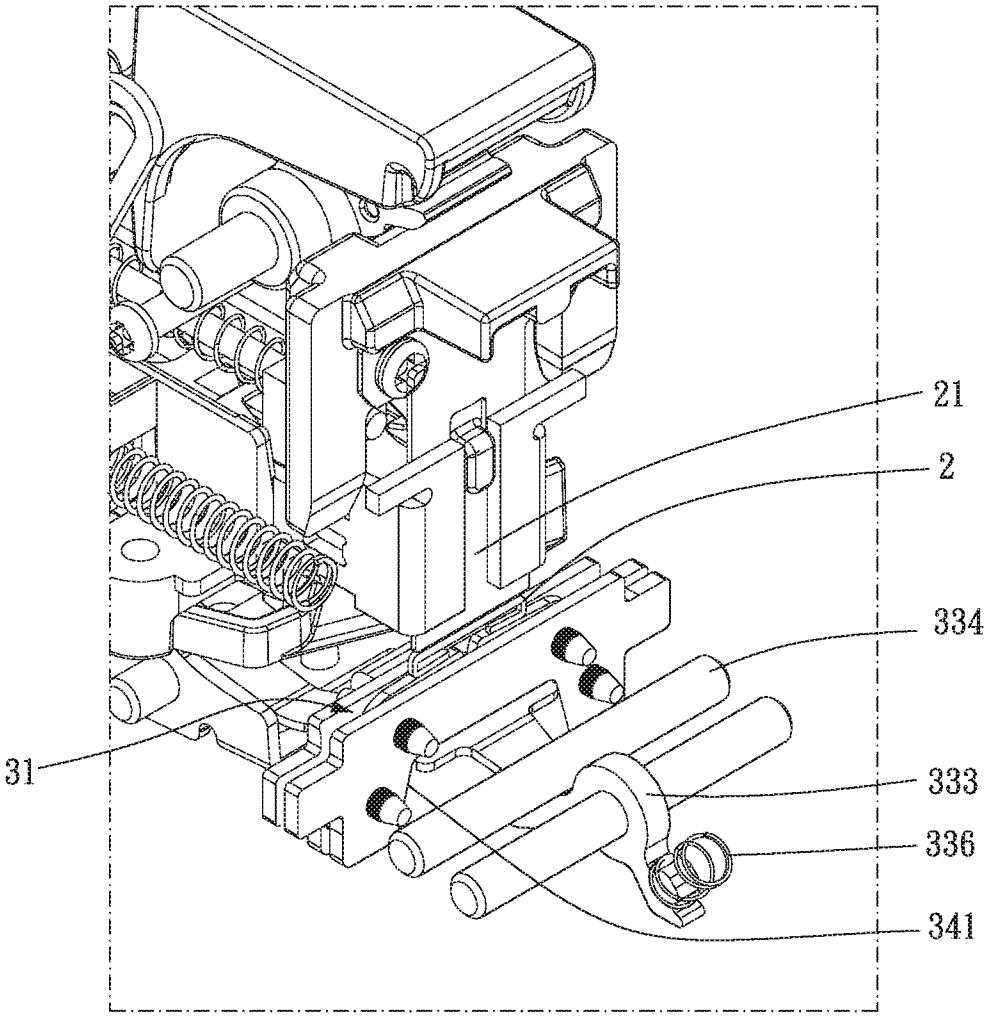
Figure 8:
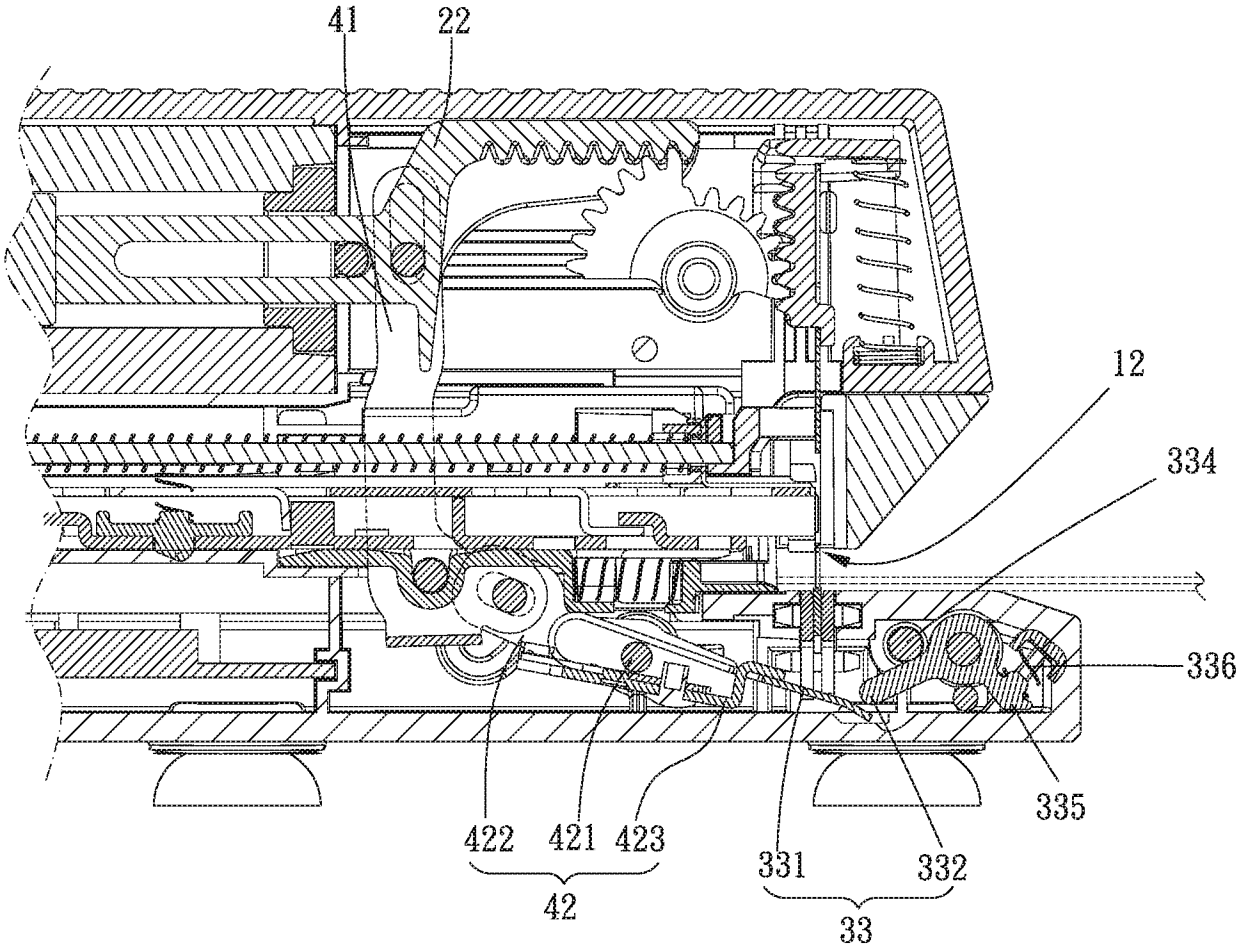
FIGS. 8 to 11 are cross-sectional views of a preferable embodiment of the present invention in operation.
Figure 9:
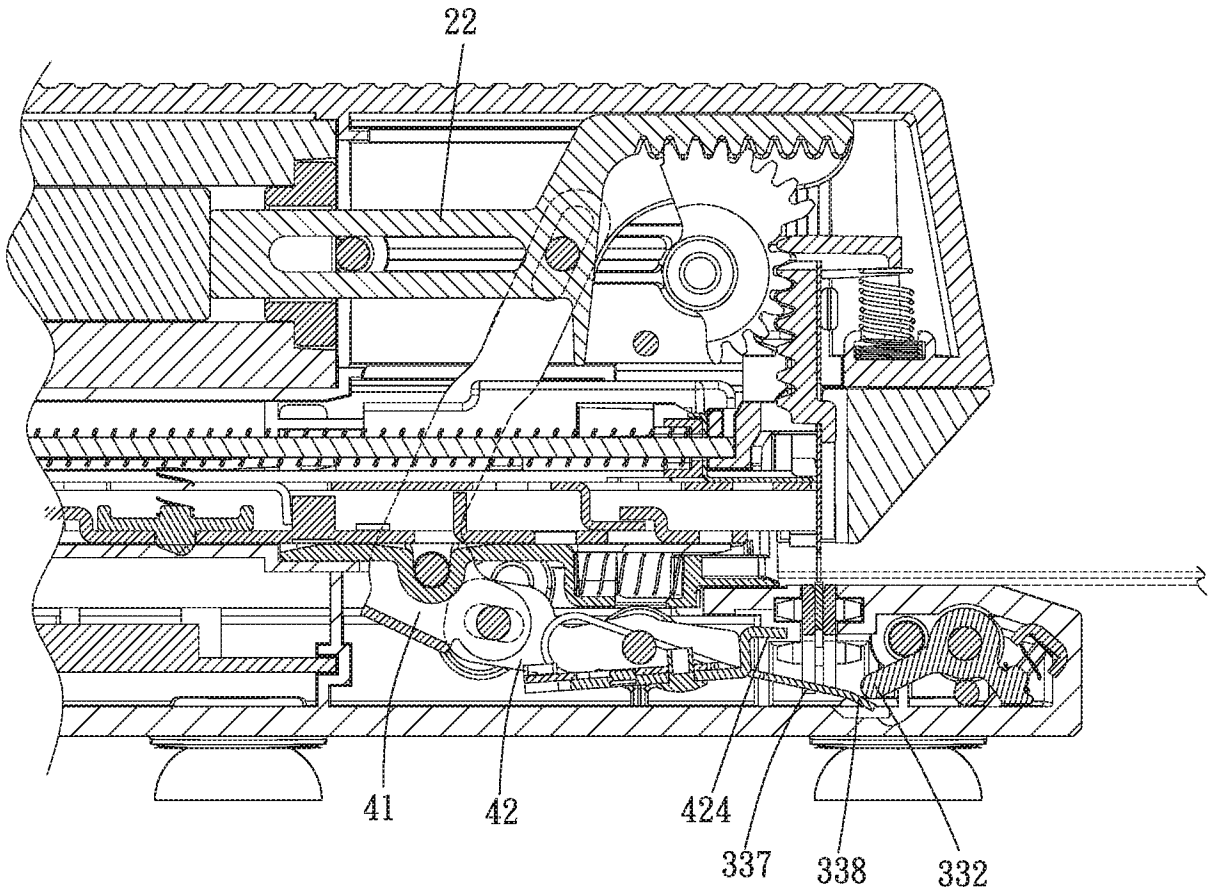
Figure 10:
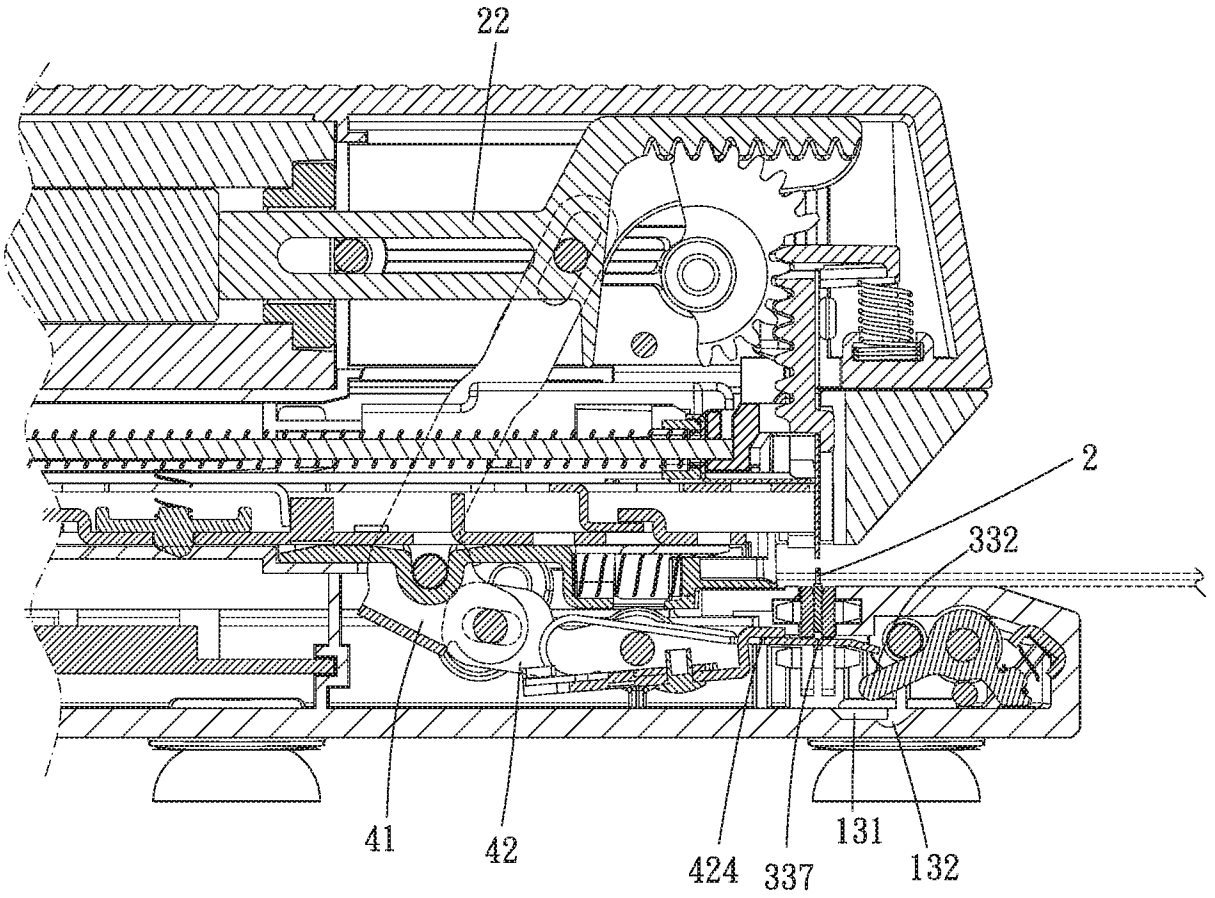

The main body 10 includes an inner space 11 and a staple outlet 12. The striking mechanism 20 is disposed in the inner space 11 and includes a striking member 21 configured to strike a staple 2 and a driving member 22 by which the striking member 21 is driven to move relative to the staple outlet 12. The staple straightening mechanism 30 is disposed on the main body 10 and includes an aperture 31 corresponding to the staple outlet 12, at least one abutting member 32 being movable within the aperture 31 and a force accumulating assembly 33 which is drivable by the driving member 22. The force accumulating assembly 33 includes a blocking portion 332 and a force accumulating member 331 which is releasebly blockable with the blocking portion 332, and the force accumulating member 331 is movable toward the aperture 31 to strike the at least one abutting member 32. When the driving member 22 drives the striking member 21 to move toward the staple outlet 12, the driving member 22 drives the force accumulating member 331 to deform and accumulate force, as shown in FIGS. 8 and 9; when the force accumulating member 331 is deformed to disengage from the blocking portion 332, the force accumulating member 331 carries out an instantaneously pulsed strike on the at least one abutting member 32 to move in a direction toward the staple outlet 12 so that the at least one abutting member 32 and the striking member 21 press and straighten the staple 2, as shown in FIG. 10. Therefore, the at least one abutting member 32 can effectively flatten the staple 2 no matter how much the strength of operating force is, thus having good leg-flatting effect.

Figure 11:
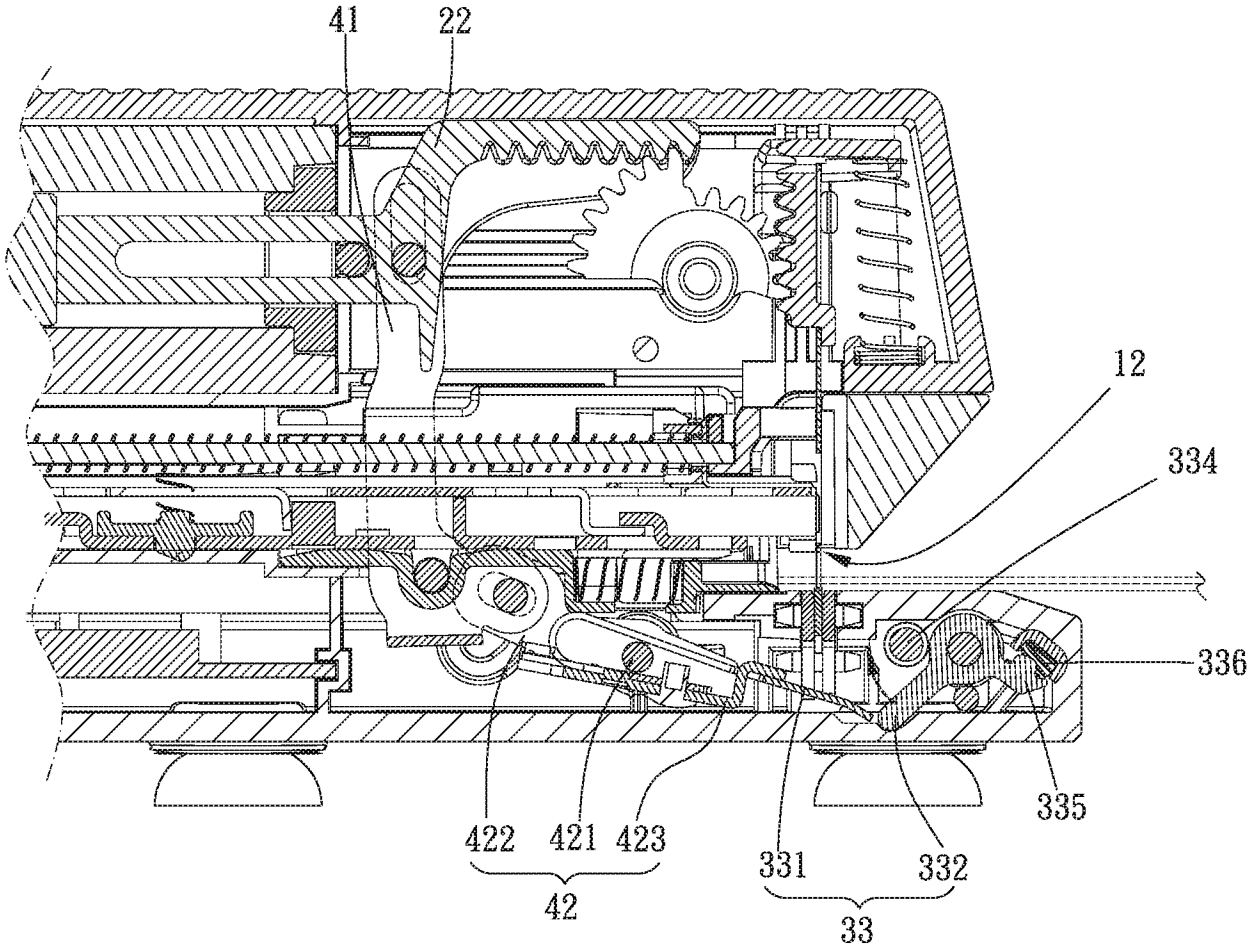

The force accumulating assembly 33 further includes a blocking member 333 rotatably disposed on the main body 10 and a restricting portion 334 being blockable with the blocking member 333, and the blocking member 333 has the blocking portion 332. When the restricting portion 334 is blocked with the blocking member 333, the blocking portion 332 keeps a predetermined distance from the at least one abutting member 32 so that the blocking portion 332 is blocked with the force accumulating member 331 in an appropriate position for preferable force accumulating effect. Preferably, the blocking member 333 further has an abutting arm 335 extending in a direction different from the blocking portion 332, and the force accumulating assembly 33 further includes an elastic member 336 which is elastically abutted against and between the abutting arm 335 and the main body 10 so that the blocking member 333 has a tendency to be blocked with the restricting portion 334. Preferably, the main body 10 has a dodge portion 13 within which at least one of the force accumulating member 331 and the blocking portion 332 is received. When the driving member 22 drives the force accumulating member 331 to move away from the at least one abutting member 32, the force accumulating member 331 pushes the blocking portion 332 to move toward the dodge portion 13, and at least part of the blocking portion 332 is received within the dodge portion 13 and allows the force accumulating member 331 to cross over the blocking portion 332 so that the force accumulating member 331 can return to its original position without deformation. In this embodiment, the dodge portion 13 includes a first recession 131 adjacent to the force accumulating member 331 and a second recession 132 adjacent to the blocking portion 332. A depth of the first recession 131 is smaller than a depth of the second recession 132, and the first recession 131 and the second recession 132 are communicated with each other so that the force accumulating member 331 and the blocking portion 332 is smoothly movable into or out of the dodge portion 13. After the force accumulating member 331 struck the at least one abutting member 32, the driving member 22 drives the force accumulating member 331 to move away from the at least one abutting member 32, and the force accumulating member 331 pushes the blocking member 333 to move toward the dodge portion 13 and compress the elastic member 336. The blocking member 333 is rotated and at least partially received within the second recession 132, which allows the force accumulating member 331 to cross over the blocking portion 332 without deformation and at least partially receive within the first recession 131 so as to return to its original position (as shown in FIG. 11). After the force accumulating member 331 crossed over the blocking portion 332, the elastic member 336 immediately pushes the blocking member 333 to be blocked with the restricting portion 334 so as to be prepared for blocking the force accumulating member 331. In other embodiment, the depths of the first and second recessions may be the same; the blocking portion may be fixedly disposed on the main body and the force accumulating member is deformable to pass through the blocking portion.

The staple straightening mechanism 30 further includes at least one supporting member 34 located between the staple outlet 12 and the force accumulating member 331. The at least one abutting member 32 is swingably disposed on the at least one supporting member 34 and swingable relative to the staple outlet 12. A side of the at least one supporting member 34 facing toward the force accumulating member 331 has a guiding mouth 341 extending toward the at least one abutting member 32, and the force accumulating member 331 includes a striking portion 337 facing toward the at least one abutting member 32. The striking portion 337 is movable toward the at least one abutting member 32 along the guiding mouth 341 so as to ensure that the force accumulating member 331 effectively strikes the at least one abutting member 32. Preferably, the at least one abutting member 32 has a first restricting portion 321, and the at least one supporting member 34 has a second restricting portion 342 which is interferable with the first restricting portion 321 in a swinging direction of the at least one abutting member 32. When the first restricting portion 321 and the second restricting portion 342 are abutted against each other, the at least one abutting member 32 is swung to be flush with or protrusive beyond the aperture 31 so as to avoid overswinging or insufficient swinging of the at least one abutting member 32. In this embodiment, the staple straightening mechanism 30 includes two said the supporting members 34 which are spaced apart from each other and define the aperture 31 and two said abutting members 32 which are rotatably disposed between the two said supporting members 34. The two said abutting members 32 face each other and are configured to respectively press one of the two legs of the staple 2. In other embodiments, the aperture may be defined by one of the two said supporting members and the main body; the main body may has the aperture disposed therethrough, and the two said abutting members may be rotatably disposed on the main body and located within the aperture.

The staple straightening mechanism 30 further includes a plurality of connecting members 35 which are connected with the two said supporting members 34. Each of the plurality of connecting members 35 has a flange 351 circumferentially disposed thereon, and the two said supporting members 34 are disposed at two opposite sides of respective flanges 351 of the plurality of the connecting members 35 so as to be spaced apart from each other and easy to assemble. Each of the two said abutting members 32 is swingably disposed between the two said supporting members 34 by one of the plurality of connecting members 35. The first restricting portion 321 includes two lugs extending integrally from the two said abutting members 32, and the second restricting portion 342 includes two of the plurality of connecting members 35 which are blockable with the two lugs, which has a simple structure and is easy to process and assemble. In other embodiments, the first restricting portion may be additionally connected with the two said abutting members; the second restricting portion may integrally extend from the two said supporting members; the first restricting portion and the second restricting portion may be a guiding projection and a guiding recession which are slidably engaged with each other. Specifically, each of the two said abutting members 32 includes an abutting surface 322 facing toward the staple outlet 12 and configured to press the staple 2, and the abutting surface 322 is a flat, concave flat or concave arcuate surface. In this embodiment, the abutting surface 322 is a flat, which can effectively flatten the two legs in the direction toward the staple outlet 12.

The stapler 1 further includes a linkage mechanism 40 disposed in the inner space 11. The driving member 22 and the force accumulating assembly 33 are connected with the linkage mechanism 40 and comovable with each other. Specifically, the linkage mechanism 40 includes a first connecting rod 41 rotatably connected with the driving member 22 and a second connecting rod 42. The second connecting rod 42 is rotatably disposed on the main body 10 by a pivot 421 and includes a first end 422 and a second end 423 which are located at two opposite sides of the pivot 421. The first end 422 is rotatably connected with the first connecting rod 41, and the second end 423 is connected with the force accumulating assembly 33. When the first connecting rod 41 pushes the first end 422 downwardly, the second end 423 is swung upwardly and the force accumulating member 331 is abutted against the blocking portion 332 to deform and accumulate force. In this embodiment, the force accumulating member 331 is disposed on the second connecting rod 42, extends toward the second end 423 and protrudes beyond the second connecting rod 42. The second end 423 of the second connecting rod 42 has a blocking shoulder 424 extending therefrom, and the blocking shoulder 424 is blockable with the force accumulating member 331 in a striking direction of the force accumulating member 331 so as to prevent the force accumulating member 331 from excessively striking the two said abutting members 32 and reduce abrasion of components. The force accumulating member 331 is an elastic sheet. The elastic sheet has an engaging tongue 338 extending transitionally and toward the blocking portion 332 and being abuttable against the blocking portion 332, and the striking portion 337 is located between the engaging tongue 338 and the blocking shoulder 424 so that the elastic sheet is easy to deform and has good force accumulating effect. Moreover, each of the first connecting rod 41 and the second connecting rod 42 includes two swing arms 411, 425 extending parallel to each other and a connecting portion 412, 426 connected between the two swing arms 411, 425, which provides stable swinging and preferable structural strength. In other embodiments, the linkage mechanism may include more than two connecting rods; the force accumulating member may be disposed on the main body or other positions; the force accumulating member may be resilient member with other configurations.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A stapler, including:

a main body, including an inner space and a staple outlet;

a striking mechanism, disposed in the inner space, including a striking member configured to strike a staple and a driving member by which the striking member is driven to move relative to the staple outlet;

a staple straightening mechanism, disposed on the main body, including an aperture corresponding to the staple outlet, at least one abutting member being movable within the aperture and a force accumulating assembly which is drivable by the driving member, the force accumulating assembly including a blocking portion and a force accumulating member which is releasebly blockable with the blocking portion, the force accumulating member being movable toward the aperture to strike the at least one abutting member;

wherein when the driving member drives the striking member to move toward the staple outlet, the driving member drives the force accumulating member to deform and accumulate force; when the force accumulating member is deformed to disengage from the blocking portion, the force accumulating member carries out an instantaneously pulsed strike on the at least one abutting member to move in a direction toward the staple outlet, and the at least one abutting member and the striking member press and straighten the staple.

2. The stapler of claim 1, wherein the force accumulating assembly further includes a blocking member rotatably disposed on the main body and a restricting portion being blockable with the blocking member, the blocking member has the blocking portion, and when the restricting portion is blocked with the blocking member, the blocking portion keeps a predetermined distance from the at least one abutting member.

3. The stapler of claim 2, wherein the blocking member further has an abutting arm extending in a direction different from the blocking portion, the force accumulating assembly further includes an elastic member which is elastically abutted against and between the abutting arm and the main body so that the blocking member has a tendency to be blocked with the restricting portion.

4. The stapler of claim 1, wherein the main body has a dodge portion within which at least one of the force accumulating member and the blocking portion is received; when the driving member drives the force accumulating member to move away from the at least one abutting member, the force accumulating member pushes the blocking portion to move toward the dodge portion, at least part of the blocking portion is received within the dodge portion and allows the force accumulating member to cross over the blocking portion.

5. The stapler of claim 1, wherein the staple straightening mechanism further includes at least one supporting member located between the staple outlet and the force accumulating member, and the at least one abutting member is swingably disposed on the at least one supporting member.

6. The stapler of claim 5, wherein a side of the at least one supporting member facing toward the force accumulating member has a guiding mouth extending toward the at least one abutting member, the force accumulating member includes a striking portion facing toward the at least one abutting member, and the striking portion is movable toward the at least one abutting member along the guiding mouth.

7. The stapler of claim 1, further including a linkage mechanism disposed in the inner space, wherein the driving member and the force accumulating assembly are connected with the linkage mechanism and comovable with each other, the linkage mechanism includes a first connecting rod rotatably connected with the driving member and a second connecting rod, the second connecting rod is rotatably disposed on the main body by a pivot and includes a first end and a second end which are located at two opposite sides of the pivot, the first end is rotatably connected with the first connecting rod, and the second end is connected with the force accumulating assembly.

8. The stapler of claim 7, wherein the force accumulating member is disposed on the second connecting rod, extends toward the second end and protrudes beyond the second connecting rod, the second end of the second connecting rod has a blocking shoulder extending therefrom, and the blocking shoulder is blockable with the force accumulating member in a striking direction of the force accumulating member.

9. The stapler of claim 1, wherein each of the at least one abutting member includes an abutting surface facing toward the staple outlet and configured to press the staple, and the abutting surface is a flat, concave flat or concave arcuate surface.

10. The stapler of claim 6, wherein the force accumulating assembly further includes a blocking member rotatably disposed on the main body and a restricting portion being blockable with blocking member, the blocking member has the blocking portion, when the restricting portion is blocked with the blocking member, the blocking portion keeps a predetermined distance from the at least one abutting member; the blocking member further has an abutting arm extending in a direction different from the blocking portion, the force accumulating assembly further includes an elastic member which is elastically abutted against and between the abutting arm and the main body so that the blocking member has a tendency to be blocked with the restricting portion; the main body has a dodge portion within which at least one of the force accumulating member and the blocking portion is received; the dodge portion includes a first recession adjacent to the force accumulating member and a second recession adjacent to the blocking portion, a depth of the first recession is smaller than a depth of the second recession; the first recession and the second recession are communicated with each other; when the driving member drives the force accumulating member to move away from the at least one abutting member, the force accumulating member pushes the blocking portion to move toward the dodge portion, at least part of the blocking portion is received within the second recession and allows the force accumulating member to cross over the blocking portion and at least partially receive within the first recession; the at least one abutting member has a first restricting portion, the at least one supporting member has a second restricting portion which is interferable with the first restricting portion in a swinging direction of the at least one abutting member, when the first restricting portion and the second restricting portion are abutted against each other, the at least one abutting member is swung to be flush with or protrusive beyond the aperture; the staple straightening mechanism includes two said supporting members which are spaced apart from each other and define the aperture and two said abutting members which are rotatably disposed between the two said supporting members, the two said abutting members face each other and are configured to respectively press one of two legs of the staple; the staple straightening mechanism further includes a plurality of connecting members which are connected with the two said supporting members, each of the plurality of connecting members has a flange circumferentially disposed thereon, the two said supporting members are disposed at two opposite sides of respective flanges of the plurality of connecting members; each of the two said abutting members is swingably disposed between the two said supporting members by one of the plurality of connecting members; the first restricting portion includes two lugs extending integrally from the two said abutting members, the second restricting portion includes two of the plurality of connecting members which are blockable with the two lugs; each of the two said abutting members includes an abutting surface facing toward the staple outlet and configured to press the staple, the abutting surface is a flat; the stapler further includes a linkage mechanism disposed in the inner space, the driving member and the force accumulating assembly are connected with the linkage mechanism and comovable with each other; the linkage mechanism includes a first connecting rod rotatably connected with the driving member and a second connecting rod, the second connecting rod is rotatably disposed on the main body by a pivot and includes a first end and a second end which are located at two opposite sides of the pivot, the first end is rotatably connected with the first connecting rod, and the second end is connected with the force accumulating assembly; each of the first connecting rod and the second connecting rod includes two swing arms extending parallel to each other and a connecting portion connected between the two swing arms; the force accumulating member is disposed on the second connecting rod, extends toward the second end and protrudes beyond the second connecting rod, the second end of the second connecting rod has a blocking shoulder extending therefrom, and the blocking shoulder is blockable with the force accumulating member in a striking direction of the force accumulating member; the force accumulating member is an elastic sheet, the elastic sheet has an engaging tongue extending transitionally and toward the blocking portion and being abuttable against the blocking portion, and the striking portion is located between the engaging tongue and the blocking shoulder.

* * * * *